US005419257A

United States Patent [19]

Leichter et al.

[11] Patent Number: 5,419,257

[45] Date of Patent: May 30, 1995

[54] DEVICE FOR SIMULTANEOUSLY EJECTING TWO FLUIDS, IN PARTICULAR TWO PYROTECHNIC FLUIDS

[75] Inventors: Geneviéve Leichter, Pibrac; Hervé Tustes, Frouzins; Marie-Jeanne Ruiz, Toulouse; Jean-Pierre Rosada, Muret, all of France

[73] Assignee: Etienne Lacroix Tous Artifices S.A., Muret, France

[21] Appl. No.: 255,261

[22] Filed: Jun. 7, 1994

[30] Foreign Application Priority Data

Jun. 8, 1993 [FR] France ..... 93 06826

[51] Int. Cl.[6] ..... F42B 3/00

[52] U.S. Cl. ..... 102/315; 102/328; 102/343

[58] Field of Search ..... 102/328, 393, 315

[56] References Cited

U.S. PATENT DOCUMENTS

| | | | |
|---|---|---|---|
| 830,056 | 9/1906 | Dowd | 102/315 X |
| 1,856,871 | 5/1932 | Kneeland | 102/328 |
| 2,161,041 | 6/1939 | Harris | 102/328 X |
| 2,899,106 | 8/1959 | Weinert | 222/82 |
| 3,018,731 | 1/1962 | Filstrup, Jr. | 102/328 X |
| 3,719,144 | 3/1973 | Tlam | 102/315 X |
| 4,920,852 | 5/1990 | Miller | 102/315 X |
| 5,136,950 | 8/1992 | Halpin | 102/336 |

FOREIGN PATENT DOCUMENTS

| | | |
|---|---|---|
| 2573858 | 5/1986 | France . |
| 2624962 | 6/1989 | France . |

*Primary Examiner*—Peter A. Nelson
*Attorney, Agent, or Firm*—Ladas & Parry

[57] ABSTRACT

A device for simultaneously ejecting two fluids, in particular pyrotechnic fluids, intended to react on contact after ejection includes a reservoir for each fluid open to the exterior of the device through a respective nozzle. The two reservoirs comprise a respective cylinder/piston combination and simultaneous ejection of the two fluids is achieved by displacement of one piston inside the respective cylinder and mechanical coupling of the pistons. The ejection rates are in constant proportion defined by the section of the piston regardless of how full the reservoirs are.

8 Claims, 1 Drawing Sheet

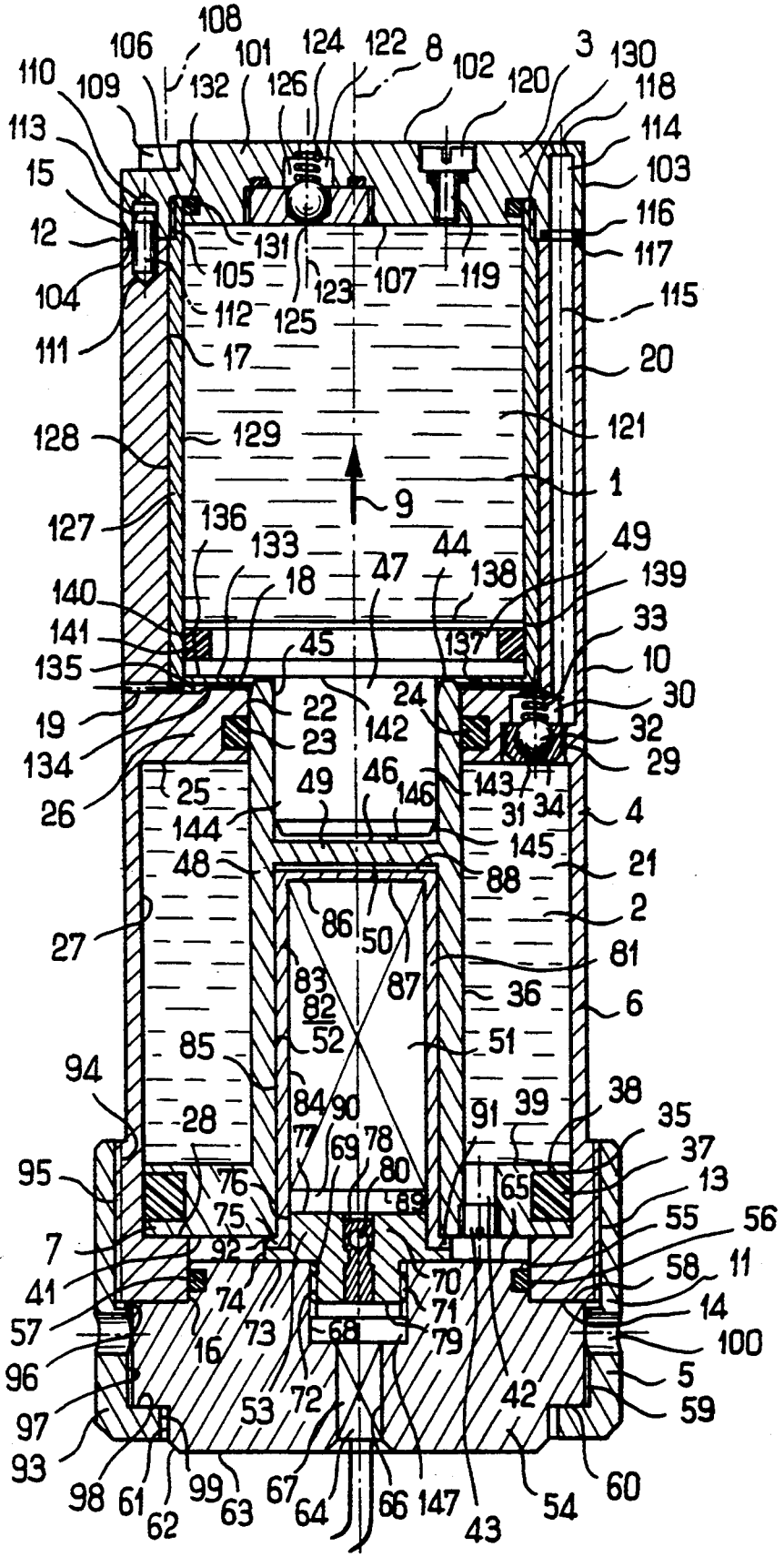
108
106
101
124
122
8
102
3
130
110
109
132
126
120
118
113
114
15
103
12
116
131
117
105
123
107
119
104
112
125
115
111
17
20
128
129
121
1
9
127
136
133
44
49
18
47
138
139
140
141
45
137
33
135
10
24
30
19
22
142
32
134
23
29
25
49
46
143
26
146
31
34
4
144
145
48
88
21
2
27
86
50
81
83
87
36
6
82
52
51
85
94
84
90
91
39
38
28
77
69
78
35
95
80
37
76
65
13
75
55
56
7
92
58
11
41
74
70
71
14
57
73
68
79
100
16
96
5
97
53
72
42
59
93
98
61
99
67
66
147
54
60
62
63
64
43

DEVICE FOR SIMULTANEOUSLY EJECTING TWO FLUIDS, IN PARTICULAR TWO PYROTECHNIC FLUIDS

BACKGROUND OF THE INVENTION

1. Field of the Invention

The present invention concerns a device for simultaneously ejecting two fluids, in particular two pyrotechnic fluids, which react on contact after such ejection, said device including:

first and second sealed reservoirs for the first and second of said fluids, respectively, the first and second reservoirs being mutually isolated to prevent contact between the first and second fluids, first and second ejector nozzles for the first and second fluids, respectively, first and second sealed conduits respectively connecting the first nozzle to the first reservoir and the second nozzle to the second reservoir and mutually isolated to prevent contact between the two fluids, means operable to simultaneously expel the first and second fluids from the first and second reservoirs to the first and second nozzles via the first and second conduits.

2. Description of the Prior Art

A device of this kind is described in Canadian patent application No 2 027 254, for example; it is in the form of an infrared flare using pressurized oxygen and a pyrophoric liquid as the first and second fluids, respectively, the pyrophoric liquid igniting spontaneously on mixing with said oxygen after ejection to cause the required infrared emission.

In these prior art devices the first reservoir is a pressurized oxygen reservoir and opening of a valve firstly ejects the pressurized oxygen into the surrounding air via the first conduit and the first nozzle and secondly introduces the pressurized oxygen into the second reservoir containing the pyrophoric liquid, not directly but through the intermediary of a flexible bladder opening onto the second conduit. As it crushes this bladder the oxygen introduced into the second reservoir expels the pyrophoric liquid from the latter via the second conduit and the second nozzle with the result that the oxygen and the pyrophoric liquid are ejected simultaneously and are mixed and react only externally of the device.

The pressure of the oxygen in the first reservoir naturally varies considerably as the oxygen is ejected. This pressure conditions the distribution of the oxygen between the second reservoir, where it serves to expel the pyrophoric liquid, and the first conduit, on leaving which it serves as the agent oxidizing the pyrophoric liquid. It also conditions the pressure and rate of ejection of the pyrophoric liquid and the oxygen, with the result that the infrared emission from a device of this kind is entirely random and highly unstable with time.

Similar problems would occur if this prior art device were to be used to eject simultaneously two fluids, in particular two pyrotechnic fluids, other than those described but also intended to react on contact after ejection, the random nature of ejection making the reaction itself random, especially in time.

SUMMARY OF THE INVENTION

An object of the present invention is to remedy these drawbacks and to this end it proposes a device for simultaneously ejecting two fluids, in particular pyrotechnic fluids, intended to react upon contact after ejection, said device comprising:

first and second sealed reservoirs for the first and second of said fluids, respectively, the first and second reservoirs being mutually isolated to prevent contact between the first and second fluids, first and second ejector nozzles for the first and second fluids, respectively, first and second sealed conduits respectively connecting the first nozzle to the first reservoir and the second nozzle to the second reservoir and mutually isolated to prevent contact between the two fluids, and means operable to expel the first and second fluids simultaneously from the first and second reservoirs to the first and second nozzles via the first and second conduits, in which device said first and second reservoirs comprise first and second coaxial cylinders closed at the end which is the downstream end with reference to a common axial direction by a respective end wall into which the first conduit or the second conduit respectively opens, and the means for simultaneously expelling the first and second fluids include first and second pistons adapted to slide axially in at least said direction inside the first and second cylinders, respectively, and closing the first and second cylinders, respectively, at the upstream end with reference to said direction, the second piston being mechanically coupled to the first piston so that sliding of the first piston in said direction inside the first cylinder causes sliding of the second piston in said direction inside the second cylinder, and means for causing sliding of the first piston in said direction inside the first cylinder.

The person skilled in the art will readily understand that in this case the pressure and the flowrate at which the first and second fluids are ejected via the first and second nozzles can be controlled, without either pressure affecting the other and under perfectly controlled conditions firstly by virtue of the choice, and where applicable the adjustment, of the means for causing sliding of the first piston in the first cylinder and secondly by virtue of an appropriate choice of the respective active cross-sections of the first and second pistons and the specifications of the first and second nozzles, i.e. that it is possible to control precisely at all times the conditions under which the first and second fluids react after they are ejected, in particular (but not exclusively) when they comprise an oxidizing fluid and a pyrophoric fluid in order to constitute an infrared flare.

In this case in particular, and more generally in all cases where accidental mixing of first and second fluids could be hazardous, the device of the invention preferably includes at least two sealed subassemblies stored separately and adapted to be assembled together for use, namely a first subassembly comprising the first cylinder containing the first fluid, the corresponding end wall and the first piston, and a second subassembly comprising the second cylinder containing the second fluid, the respective end wall and the second piston. The device may further comprise a third subassembly separate from the first and second subassemblies in storage and assembled to the first and second subassemblies for use, the third subassembly including the means for causing sliding of the first piston.

The first and second subassemblies, previously loaded with the first and second fluids, respectively, can then be stored separately, under conditions such that accidental mixing of the first and second fluids is impossible; the first and second subassemblies are assembled together only at the time of use; the optional third subassembly can also be stored under optimum safety conditions and assembled to the other two subassemblies only at the time of use; this is particularly beneficial when, as in a preferred embodiment of the invention, the means causing the first piston to slide include a pyrotechnic pressurized gas generator, the pressurized gas acting on the first piston in the first cylinder, opposing the action of the first fluid.

The person skilled in the art has a free choice of the relative positions of the first and second cylinders and the means for causing the first piston to slide, depending on the conditions under which the device is installed and consequently the required external shape of the device and the usual dimensions of devices which the device of the invention is intended to replace.

For example, if the device of the invention is to have an exterior configuration that is relatively wide perpendicular to its axis and flat parallel to this axis, the first and second cylinders can be disposed one within the other, for example with the second cylinder around the first cylinder which in turn at least partially surrounds the means for causing the first piston to slide. The device of the invention can also have a greater overall dimension along its axis than perpendicular thereto, as is frequently the case with flare devices, in which case the means for causing the first piston to slide and the first and second cylinders are mutually aligned axially in said direction; this in-line arrangement is particularly beneficial when the device of the invention is constructed from two or three subassemblies which are assembled together at the time of use, although such implementation as a plurality of subassemblies is also feasible when at least the first and second cylinders are disposed one within the other.

If an in-line arrangement is adopted for the means for causing the first piston to slide and the first and second cylinders the mechanical coupling of the second piston to the first piston is advantageously obtained by providing the latter with an axial rod for pushing the second piston in said direction, said rod projecting axially in said direction relative to the first piston, through the first cylinder and the respective end-wall, to engage the second piston. This provides the required mechanical coupling in a particularly simple and reliable way, especially if the device is implemented in the form of at least two subassemblies to be assembled at the time of use.

The rod can easily be sealed to the end-wall of the first cylinder and the rod and the second piston can easily be sized so that the mutual assembly of the two subassemblies automatically procures abutment of the rod in said direction against the second piston, so that any subsequent movement of the first piston in said direction, within the first cylinder, due to the action of the means provided for this purpose, necessarily causes identical movement of the second piston inside the second cylinder. In this way, prior to actuation of the means for causing the first piston to slide in said direction inside the first cylinder, the rod can have a specific clearance relative to the second piston so that in a first stage of movement of the first piston in said direction inside the first cylinder, accompanied by initial expulsion of the first fluid, the second piston remains immobile in the second cylinder and therefore does not cause any expulsion of the second fluid; after the clearance in question has been taken up by the first piston the two pistons begin to move together and simultaneously expel the first and second fluids from the first and second cylinders. By offsetting the expulsion of the first and second fluids in time in this way, it is possible either to establish a predetermined offset between ejection of the first and second fluids via the nozzles, or to ensure that the start of ejection of the two fluids is properly synchronized, despite any difference between the lengths of the first and second conduits, the first conduit being longer than the second when, in the embodiment of the device mentioned above, the first cylinder is disposed between the means for causing the first piston to slide and the second cylinder.

It is also possible to affect the start of ejection of the first and second fluids and the flowrate and pressure conditions under which ejection occurs, for example to ensure that they are at least approximately constant during ejection, on the one hand, and to seal the first and second reservoirs from the external environment before use of the device, on the other hand, by providing the latter with a normally closed valve with predetermined characteristics at the opening of each of the first and second conduits onto the respective end-wall, this valve opening towards the first or second conduit, respectively, if the pressure in the first or second cylinder, respectively, exceeds a predetermined threshold.

The shape and, where applicable, the adjustment of the nozzles and the characteristics of the means for causing the first piston to slide are further factors affecting the conditions under which the first and second fluids are ejected and consequently the conditions under which they react, as will be readily understood by the person skilled in the art who will be able to make the most suitable choice in each of these regards.

The person skilled in the art will additionally be able to provide any ancillary arrangements tending to enhance the functionality and, where applicable, the safety of the device of the invention.

Some of these arrangements, along with other features and advantages of the invention, emerge from the following description relating to a non-limiting embodiment of the invention and the appended drawings which form an integral part of this description.

DETAILED DESCRIPTION OF THE PREFERRED EMBODIMENT

The single figure is a view in axial cross-section of an infrared flare in accordance with the present invention and using a strongly reducing pyrophoric fluid 1 and an oxidizing fluid 2; these fluids are liquids, for example, and their respective nature will be evident to the person skilled in the art.

The device is obtained by assembling together at the time of use two subassemblies 3 and 4 respectively containing the pyrophoric fluid 1 and the oxidizing fluid 2 and a subassembly 5. The three subassemblies 3, 4, 5 are initially separate and stored separately, although it is to be understood that the device could also be implemented differently, and in particular in the form of a single assembly stored ready for use.

For simplicity the subassembly 4 on which the subassemblies 3 and 5 are mounted when the device of the invention is to be used is described first.

The subassembly 4 essentially comprises a tubular body 6 and a piston 7 inside the latter, both having the shape of a body of revolution about a common axis 8 along which the subassemblies 3, 4, 5 are disposed in this order and which defines for each of them an axis of symmetry of revolution with reference to the condition ready for use, as shown, in which the three subassemblies 3, 4, 5 are assembled together.

Any use hereinafter of the terms "longitudinal" and "transverse" relates to a longitudinal direction defined by the axis 8; further, any use hereinafter of the terms "upstream" and "downstream" relates to a particular direction 9 along the axis 8.

In the direction away from the axis 8 the tubular body 10 is delimited by an exterior peripheral surface 10 which is a cylinder of revolution about this axis and extends longitudinally from an upstream transverse end 11 of the subassembly 4 to its downstream transverse end 12. In the immediate vicinity of the upstream transverse end 11 the external peripheral surface 10 of the tubular body 6 has a screwthread 13 concentric with the axis 8 for assembling the subassembly 5 to the subassembly 4, as described below.

At each transverse end 11, 12 of the tubular body 6 the outside peripheral surface 10 of the latter merges with a respective plane annular face concentric with the axis 8 and to which it is perpendicular, namely an upstream surface 14 and a downstream surface 15.

In the direction towards the axis 8 the transverse surface 14, 15 merges with a respective internal peripheral surface 16, 17 which is a cylinder of revolution about the axis 8 and faces the latter.

The internal peripheral surface 17, adjoining the downstream transverse surface 15, extends longitudinally upstream over slightly less than half the longitudinal dimension of the tubular body 6 between the surfaces 14 and 15, as far as a plane transverse annular surface 18 concentric with the axis 8 to which it is perpendicular. The surface 18 faces upstream and thus extends from the surface 17 towards the axis 8.

At the surface 18 a vent passage 19 which is radial relative to the axis 8 is provided between the inside peripheral surface 17 and the outside peripheral surface 10. A straight longitudinal conduit 20 is formed between the inside peripheral surface 17 and the outside peripheral surface 10, in a part of the tubular body 6 which is offset angularly relative to the vent passage 19 relative to the axis 9. The conduit 20 opens downstream into the transverse surface 15 and upstream, in a manner to be described in more detail below, into a reservoir 21 in the subassembly 4 to contain the oxidizing agent 2.

In the direction towards the axis 8 the surface 18 merges with an inside peripheral surface 22 of the tubular body 6 which is a cylinder of revolution about the axis 8 and faces towards the latter, with a diameter less than that of the surface 17. This inside peripheral surface 22 has an annular groove 23 in it concentric with the axis 8, open towards the latter and accommodating a seal 24 for an axial longitudinal piston rod 48 of the piston 7, to be described below.

The surface 22, with the groove 23 in it, thus extends upstream from the surface 18 to another plane transverse surface 25 facing upstream and also of annular shape concentric with the axis 8, to which it is perpendicular.

The surfaces 18, 22, 25 define inside the tubular body 6 a continuous annular flange 26 projecting towards the axis 8 over approximately half the longitudinal dimension of the tubular body 6 between its end surfaces 14 and 15.

The surface 25 therefore joins the surface 22, in the direction away from the axis 8, to an inside peripheral surface 27 of the tubular body 6, which surface 27 is a cylinder of revolution about the axis 8, which it faces, and has a diameter greater than the respective diameter of the inside peripheral surfaces 22 and 17 but less than that of the inside peripheral surface 16.

From the surface 25, this surface 27 extends longitudinally upstream over slightly less than half the longitudinal dimension of the tubular body 6 between its end surfaces 14 and 15 and is joined to the inside peripheral surface 16 by plane annular surface 28 concentric with the axis 8, to which it is perpendicular, and facing downstream.

The surface 7 of the tubular body 6 defines a cylinder in which the piston 7 is coaxially accommodated and can slide longitudinally and whose surface 25 defines the end wall; the conduit 20 opens upstream into this end wall surface 25 via a valve 29 accommodated in a cavity 30 in the flange 26 and constituting a localized widening of the conduit 20 in the immediate vicinity of its opening 31 onto the surface 25.

The normally closed valve 29 opens if a pressure exceeding a predetermined threshold occurs at the opening 31 of the conduit 20, relative to the remainder of the conduit 20. It is shown by way of non-limiting example in the form of a valve including a ball 32 accommodated inside the cavity 30 spring-loaded in the upstream direction by a longitudinal coil spring 33, also accommodated in the cavity 30, in order to apply it to an annular seat 34 around the opening 31.

Other embodiments of the valve 29 are naturally acceptable without this departing from the scope of the present invention.

To guide its longitudinal sliding movement inside the tubular body 6 the piston 7 has, in contact with the inside peripheral surface 27 of the tubular body 6, an outside peripheral surface 35 which is a cylinder of revolution about the axis 8 and whose diameter is substantially equal to that of the inside peripheral surface 27 and, in contact with the inside peripheral surface 22 of the tubular body 6, an outside peripheral surface 36 which is also a cylinder of revolution about the axis 8 but whose diameter is less than that of the surface 35, being equal to that of the surface 22. This surface 36 defines the piston rod 48 of the piston 7, sealed to the surface 22 of the tubular body by the seal 24. A seal is provided between the surfaces 35 and 27 in a similar manner, in that an annular groove 37 concentric with the axis 8 is provided on the inside of the outside peripheral surface 35, opening in the direction away from the axis 8, the groove 37 accommodating a seal 38.

The two surfaces 35 and 36 facing away from the axis 8 are joined at their respective downstream and upstream ends by a plane annular surface 39 concentric with the axis 8, to which it is perpendicular, which surface 39 faces downstream and therefore faces the surface 25.

The surfaces 25 and 27 of the tubular body 6 and the surfaces 39 and 36 of the piston 7 together define the reservoir 21 for the oxidizing agent 2, which reservoir 21 is sealed as is the conduit 20 to which it is connected via the valve 29.

In the upstream direction, the outside peripheral surface 35 of the piston 7 is joined to a plane annular surface 41 concentric with the axis 8, to which it is perpendicular and which faces upstream and rests against the surface 28 of the tubular body 6 in an upstream limit position of the piston 7 relative to the latter, shown in the figure and representing a maximal longitudinal distance between the surface 39 of the piston 7 and the surface 25 of the flange 26 of the tubular body 6, i.e. a maximal volume of the reservoir 21 of oxidizing agent 2; an orifice 42 for filling the reservoir 21 with oxidizing agent 2 is provided longitudinally between the surfaces 41 and 39 and is sealed by a plug 43 after the reservoir 21 is filled with the oxidizing agent 2, with the surface 41 bearing on the surface 28.

Longitudinal movement of the piston 7 in the downstream direction inside the tubular body 6 obviously causes a progressive reduction in the volume of the reservoir 21 as the surfaces 39 and 25 move towards each other, which expels the oxidizing agent 2 towards the conduit 20, through the valve 29, as soon as the predetermined pressure at which the latter opens is reached in the reservoir 1.

The surface 36 extends longitudinally downstream from where it Joins the surface 39 and over a distance such that when the surface 41 of the piston 7 bears on the surface 28 of the tubular body 6 the surface 36 extends longitudinally through the flange 26, i.e. ends slightly upstream of the latter, where it joins onto a plane annular surface 44 concentric with the axis 8, to which it is perpendicular, which surface 44 faces downstream and defines the downstream end of the piston rod 48 of the piston 7.

The surface 44 joins onto the surface 36 in the direction away from the axis 8 and in the direction towards the latter joins onto an inside peripheral surface 45 which is a cylinder of revolution about the axis 8 towards which the surface 45 faces.

In the downstream direction the surface 45 joins the surface 44 to a transverse surface 46 facing downstream and in the form of a disk perpendicular to the axis 8.

The surfaces 45 and 46 thus delimit a longitudinal cavity 47 flanked by the surface 44 and opening in the downstream direction. This cavity 47 is designed to improve cooperation between the piston rod 48 of the piston 7 and a piston 49 of the subassembly 3 to be described below.

The surface 46 of the cavity 47 delimits in the downstream direction a transverse wall 49 delimited in the upstream direction by a transverse surface 50 in the shape of a plane disk perpendicular to the axis 8, which surface 50 defines the downstream limit of another cavity 51 inside the piston rod 48 of the piston 7 and opening into the surface 41 of the latter.

To this end the cavity 51 is delimited in the direction away from the axis 8 by an inside peripheral surface 52 which is a cylinder of revolution about the axis 8 and faces towards the latter, with a diameter equal, for example, to that of the inside peripheral surface 45 delimiting the cavity 47. This surface 52 extends upstream from the surface 50 as far as the surface 41 of the piston 7.

When the subassembly 5 is assembled to the subassembly 4 a pyrotechnic generator 53 of pressurized gas is longitudinally nested inside the cavity 51 in the piston 7 of the subassembly 4. The generator 53 is part of the subassembly 5 and its function is to displace the piston 7 inside the tubular body 6 from the position shown, representing the maximal volume of the reservoir 21, filled with oxidizing agent 2, to a position (not shown) in which its surface 39 is immediately adjacent the surface 25 of the flange 26 on the tubular body 6, the reservoir 21 then having a null or substantially null volume and having been emptied of the oxidizing agent 2 through the valve 29 and the conduit 20 by virtue of this movement.

Accordingly, the design of the subassembly 5 is described next, with reference to the position that the subassembly 5 occupies when it is assembled to the subassembly 4 and the piston 7 of the latter is in its upstream limit position, as shown in the figure.

In the subassembly 5 the pyrotechnic generator 53 is carried by a flat transverse plug 54 fastened to and mutually nested in the longitudinal direction with the transverse end surface 14 and inside the inside peripheral surface 16 directly adjacent the surface 14 of the tubular body 6.

To this end the plug 54 is delimited by an outside peripheral surface 55 which is a cylinder of revolution about the axis 8, facing away from the latter and having a diameter substantially equal to that of the inside peripheral surface 16 of the tubular body 6 so that the surface 55 can nest longitudinally inside the surface 16 with virtually no clearance. To provide a seal between the sealed plug 54 and the sealed tubular body 6, an annular groove 56 concentric with the axis 8 is formed in the surface 55. Open in the direction away from the axis 8, this groove 56 accommodates a seal 57.

In the upstream direction the surface 55 joins onto a plane transverse annular surface 58 concentric with the axis 8, to which it is perpendicular, which faces downstream and which bears on the surface 14 of the tubular body 6.

In the direction away from the axis 8 the surface 58 joins onto an outside peripheral surface 59 of the plug 54 which is a cylinder of revolution about the axis 8, faces away from the latter and has a diameter less than the root diameter of the screwthread 13.

The surface 59 therefore joins the surface 58 in the upstream direction to a plane annular surface 60 concentric with the axis 8 to which it is perpendicular, which surface 60 faces upstream.

Between the surface 60 and the axis 8 the plug 54 is delimited in the upstream direction by consecutive surfaces 61, 62, 63 whose shape is immaterial, although preferably the shape of a body of revolution about the axis 8; in the example shown the surface 61 is a cylinder of revolution about the axis 8 and faces away from the latter, the surface 62 is a frustoconical surface of revolution about the axis 8, of reducing size in the upstream direction, and the plane surface 6 is in the shape of a disk concentric with the axis 8 to which it is perpendicular, this surface 63 facing upstream.

In line with the axis 8, a passage 64 passing axially through the plug 54 opens onto the surface 63. In the downstream direction it opens onto a surface 65 of the plug 54. The surface 65 is a plane annular surface concentric with the axis 8, to which it is perpendicular, and faces downstream; in the direction away from the axis 8 it joins the passage 64 to the surface 55 and because the longitudinal dimension of the latter is less than the inside peripheral surface 16 of the tubular body 6 it faces the surface 41 of the piston 7, from which it is longitudinally spaced even when the piston 7 is at its upstream limit position representing the maximal volume of the reservoir 21, as shown.

The passage 64 has two sections in succession in the direction 9, i.e. from its opening onto the surface 63 to its opening onto the surface 65, namely an upstream section 66 which is comparatively narrow and retains an electric ignitor 67 and a downstream section 147 which is relatively wide, adjoins the surface 65 and is delimited in the direction away from the axis 8 by an inside peripheral surface 68 which is a cylinder of revolution about the axis 8 with a screwthread 69 in the immediate vicinity of the its junction with the surface 65.

The screwthread 69 fastens onto the plug 54 an end-piece 70 which to this end has an outside peripheral surface 71 which is a cylinder of revolution about the axis 8, faces away from the latter and has a screwthread 72 complementary to the screwthread 69.

In the downstream direction the surface 71 is joined onto a plane annular surface 73 of the end-piece 70 concentric with the axis 8, to which it is perpendicular, and facing upstream so that it bears on the surface 65 around the opening of the passage 64 onto the latter.

In the direction away from the axis 8 the surface 73 is joined onto an outside peripheral surface 74 of the end-piece 70 which is a cylinder of revolution about the axis 8 and faces away from the latter. Its diameter is between the respective diameters of the inside peripheral surface 52 of the piston 7 and the inside peripheral surface 16 of the tubular body 6, than which it is respectively larger and smaller.

In the downstream direction the surface 74 is joined onto a plane annular surface 75 concentric with the axis 8, to which it is perpendicular, which faces downstream and which therefore faces the surface 41; the longitudinal dimension of the surface 74 is, however, less than the longitudinal distance between the surface 41 of the piston 7 in the upstream limit position and the surface 65 of the plug 54; it is in the order of half this distance, for example, so that there is no contact between the surface 75 and the surface 41 even with the piston 7 at its upstream limit position.

In the direction towards the axis 8 the surface 75 is joined onto an outside peripheral surface 76 of the end-piece 70 which is a cylinder of revolution about the axis 8 with a diameter less than that of the inside peripheral surface 52 of the piston 7, although preferably greater than that of the outside peripheral surface 71.

In the downstream direction this surface 76 is joined onto a plane annular surface 77 facing downstream and concentric with the axis 8, to which it is perpendicular.

In the direction towards the axis 8 the surface 77 is joined onto an axial passage 78 through the end-piece 70 and opening onto a plane annular surface 79 concentric with the axis 8, to which it is perpendicular, and delimiting the end-piece 70 at the upstream end.

The passage 78 accommodates a pyrotechnic check valve 80 which is open in the direction 9, i.e. in the direction of propagation of hot gas generated by the ignitor 67 in the downstream direction through the passage 78, and closed in the opposite direction.

A container 81 accommodated inside the cavity 51 of the piston 7 nests without mutual fastening in the end-piece 70 of the plug 54, in particular when the piston is at its upstream limit position. The container holds a pyrotechnic substance 82 which can be ignited by the ignitor 67 to produce gases propelling the piston 7 in the downstream direction inside the tubular body 6.

For safety reasons the container 81 holding the pyrotechnic substance 82 can be nested in the end-piece 70, by mutual longitudinal inter-engagement thereof, immediately before the subassembly 5 is assembled to the subassembly 4, so that the ignitor 67 can be stored separately until this time, for optimum safety.

To enable it to be nested longitudinally with the end-piece 70 and inside the cavity 51 the container 81 has a longitudinal tubular wall 83 delimited towards the axis 8 and in the direction away from the latter by respective surfaces which are cylinders of revolution about this axis, namely an inside peripheral surface 84 facing towards the axis and having a diameter substantially equal to that of the outside peripheral surface 76 of the end-piece 70 and an outside peripheral surface 85 facing away from the axis 8 with a diameter substantially equal to that of the inside peripheral surface 52 of the piston rod 48 of the piston 7. The inside peripheral surface 84 of the wall 83 therefore nests over the outside peripheral surface 76 of the end-piece 70 and its outside peripheral surface 85 nests inside the inside peripheral surface 52 of the piston rod 48, in both cases with just sufficient radial clearance to enable relative longitudinal sliding. The wall 83 is sealed and in the downstream direction joins onto a sealed end wall 86 so that the cavity 51 is sealed everywhere except at the upstream end. The end wall 56 is a flat transverse wall delimited in the upstream and downstream directions by respective plane surfaces 87 and 88 which are disk-shaped, perpendicular to the axis 8 and concentric therewith. When the device is ready for use, i.e. after the subassemblies 4 and 5 have been assembled together but with the piston 7 still at its upstream limit position inside the tubular body 6 so that the reservoir 21 has its maximal volume, the surface 88 adjoins the surface 50 of the wall 49 with virtually no clearance.

The pyrotechnic substance 82 poured or packed in the container 81 directly adjoins the surfaces 84 and 87 to which it is attached; in the state of the device as shown, it has facing the surface 77 of the end-piece 70 a plane surface 89 perpendicular to the axis 8 and facing upstream, with a longitudinal spacing relative to the surface 77 of the end-piece 70 such that there remains between them, inside the container 81, a volume 90 for expansion of the gas generated by combustion of the pyrotechnic substance 82 sufficiently small not to impede ignition of the substance 82 by the ignitor 67 through the valve 80.

In the upstream direction the tubular wall 83 joins onto an annular transverse rim 91 concentric with the axis 8 and projecting in the direction away from the latter on the outside peripheral wall 85. In the direction away from the axis 8 this rim 91 is delimited by an edge 92 which is a cylinder of revolution about the axis 8 with a diameter equal to that of the outside peripheral surface 74 of the end-piece 70; in the longitudinal direction the rim 91 has a dimension substantially equal to the difference between the longitudinal dimension of the end-piece 70 between its surfaces 73 and 75 and the longitudinal distance between the surface 41 of the piston 7 in its upstream limit position and the surface 65 of the plug 54 so that the rim 91 is immobilized without play between the piston 7 and the end-piece 70 when the piston 7 is at its upstream limit position.

With the device in this initial condition, if the ignitor 67 is operated the flame transmitted through the valve 80 to the pyrotechnic substance 82 ignites the latter to generate gas in the volume 90 and the pressure of the gas so generated tends to move the container 81 in the downstream direction, entraining the piston 7 with it relative to the end-piece 70 and the plug 54, which are fastened to the tubular body 6. This causes an increase in the pressure of the oxidizing agent 2 inside the reservoir 21 and when this pressure exceeds the predetermined threshold at which the valve 29 opens the oxidizing agent 2 escapes from the reservoir 21 to the conduit 20 which is open to the outside (see below); the container 81 and the piston 7 move downstream together relative to the tubular body 6, inside the cylinder defined by the inside peripheral surface 27 of the latter, and the initial gas expansion volume 90 expands to all of the intermediate space between the piston 7 and the plug 54 as soon as, during this downstream movement of the container 81 and the piston 7, the container 81 is released from the end-piece 70. The pyrotechnic substance 82 is sufficient for the gas generated to displace the piston 7 to its downstream limit position relative to the tubular body 6, in which position its surface 39 is adjacent the surface 25 of the latter.

The plug 54 is naturally fastened to the tubular body 6 by means offering sufficient resistance to the pressure of the gas. In the example shown the subassembly 5 includes to this end a ring 93 for applying a longitudinal downstream clamping force to the surface 58 of the plug 54 and to the surface 14 of the tubular body 6. The ring 93 is screwed onto the screwthread 13 of the tubular body 6.

The clamping ring 93 is an annular body of revolution about the axis 8 and to this end has in a downstream end portion an inside peripheral surface 94 which is a cylinder of revolution about the axis 8 with a screwthread 95 concentric with the axis 8 and complementary to the screwthread 13 with which it is engaged.

In an intermediate longitudinal region the screwthreaded surface 94 is joined by a plane annular shoulder 96 concentric with the axis 8, to which it is perpendicular and which faces downstream, onto an inside peripheral surface 97 which is a cylinder of revolution about the axis 8 with a diameter approximately equal to that of the outside peripheral surface 59 of the plug 54 to enable unimpeded relative rotation about the axis 8 and relative longitudinal movement in translation.

In an upstream end portion of the clamping ring 93 the inside peripheral surface 97 is joined to another plane annular shoulder 98 concentric with the axis 8, to which it is perpendicular and which faces downstream, which shoulder 98 bears in the longitudinal direction on the surface 60 of the plug 54, in the downstream direction, in order to press the surface 14 of the plug 54 against the surface 58 of the tubular body 6. To this end the shoulder 98 is spaced longitudinally from the shoulder 96 by a distance less than the longitudinal distance between the surfaces 58 and 60 of the plug 54.

In the direction towards the axis 8 the surface 98 is joined onto an inside peripheral surface 99 of the clamping ring 93 which is a cylinder of revolution about the axis 8, faces towards the latter and has a diameter greater than that of the surface 60 of the plug 54.

The shape of the clamping ring 93 is immaterial provided that nothing prevents it rotating about the axis 8 relative to the plug 54 and the tubular body 6. To facilitate its inter-engagement with a tool to cause such rotation it advantageously has three radial holes 100 equi-angularly spaced about the axis 8 (this technique is known in itself in the screwed coupling art), it being understood that other modes of operating on the clamping ring 93 and other modes of fixing the plug 54 to the tubular body 6 can be used without departing from the scope of the present invention.

In accordance with the present invention the progressive expulsion of the oxidizing agent 2 from the reservoir 21 is accompanied by the progressive expulsion of the pyrophoric substance 1 by the piston 49 in the subassembly 3 described next.

The subassembly 3 includes a flat transverse longitudinal end plate 101 delimiting the device at the downstream end when the three subassemblies 3, 4, 5 are assembled together.

On the downstream side the plate 101 is delimited by a plane surface 102 perpendicular to the axis 8 and forming a disk with a diameter substantially equal to that of the outside peripheral surface 10 of the tubular body 6.

In the direction away from the axis 8 the surface 102 is joined onto an outside peripheral surface 103 which is a cylinder of revolution about the axis 8, faces away from the latter and has a diameter substantially equal to that of the outside peripheral surface 10 which the surface 103 accordingly extends when the subassembly 3 is assembled to the subassembly 4.

In the upstream direction the outside peripheral surface 103 is joined onto a plane annular surface 104 facing upstream, concentric with the axis 8 and perpendicular thereto. This surface 104 of the plate 101 bears in the upstream direction on the surface 15 of the tubular body 6 when the subassembly 3 is assembled to the subassembly 4.

In the direction towards the axis 8 the annular surface 104 has a diameter approximately equal to that of the inside peripheral surface 17 of the tubular body 6 and at this level is joined onto an inside peripheral surface 105 of the plate 101 which thus has a diameter approximately equal to that of the surface 17, to be more precise slightly less than that of the surface 17 in the example shown.

In the downstream direction the inside peripheral surface 105 is joined by an annular groove 106 concentric with the axis 108 and recessed longitudinally into the plate 101 to a plane surface 107 forming a disk perpendicular to the axis 8, concentric with the latter and facing upstream.

The subassembly 3 is fixed to the subassembly 4 by the plate 101 and to this end has equi-angularly distributed longitudinal holes (no reference number) through it around the axis 8, with respective longitudinal axes 108 at its annular surface 104 to receive bolts 109 for clamping it to the surface 15 of the tubular body 6. Other means of achieving this can naturally be used without departing from the scope of the present invention.

In the surface 104, between the surfaces 103 and 105, and in the surface 15, between the surfaces 10 and 17, there is a respective longitudinal blind hole 110, 111, the longitudinal axes of the two blind holes 110 and 111 being coincident to constitute a single longitudinal axis 112 when the plate 101 and the tubular body 6 have a specific angular orientation about the axis 8, in which they are assembled together. To prevent assembly of the plate 101 and tubular body 6 in other angular orientations about the axis 8, i.e. to constitute polarizer means, the two blind holes 110, 111 enclose a common longitudinal pin 113 nested longitudinally in one of them before assembly and having a longitudinal dimension such that it projects relative to the respective transverse surface 104 or 15 and is engaged in the other blind hole 110, 111 when the end plate 101 is fitted to the tubular body 6 by relative longitudinal movement towards each other.

The plate 101 must be oriented in a predetermined way relative to the tubular body 6 when they are assembled together in that this assembly must result in placing, in longitudinal downstream alignment with the conduit 20 of the tubular body 6, a conduit 114 passing longitudinally through the plate 101 between its surface 104 and its surface 102 at a distance from the axis 8 equal to the distance between the latter and the conduit 20 of the tubular body 6, so that the conduits 114 and 20 have a common longitudinal axis 115 when the plate 101 and the tubular body 6 are assembled together with the aforementioned angular orientation about the axis 8.

Like the conduit 20, the conduit 114 is sealed by virtue of the plate 101 being made from an intrinsically sealed material. Where the conduits 114 and 20 join together, the seal is maintained by an annular seal 116 concentric with the axis 115 inserted in an annular groove 117 concentric with the axis 115 formed in the surface 104 around the opening of the conduit 114 onto the latter; when the plate 101 is assembled to the tubular body 6 the seal 116 housed in the groove 117 is crushed longitudinally between them.

The conduit 114 opens onto the surface 102 through a nozzle 118 for ejecting the oxidizing fluid, which nozzle 118 has in the downstream direction a curve towards the axis 8 so that the oxidizing fluid 2, when it is expelled from the reservoir 21 by downstream movement of the piston 7 and passes successively through the valve 29, the conduit 20, the conduit 114 and the nozzle 118, escapes out of the device in the downstream direction and towards the axis 8.

Between its surfaces 107 and 102 the plate 101 has, firstly, a longitudinal orifice 119 through it which is normally sealed by a plug 120 and is used to fill with pyrophoric fluid 1 a reservoir 121 that its surface 107 seals inside the subassembly 3 and, secondly, by a conduit 122 through which the pyrophoric fluid 1 escapes from the reservoir 121.

The conduit 122 has a longitudinal axis 123 substantially closer to the axis 8 than the axis 115 of the conduit 114 and on the opposite side of the axis 8 relative to the axis 115, in a common longitudinal plane with the axis 8 and constituting the section plane of the figure.

The conduit 122 opens onto the surface 102 on the axis 123 through a nozzle 124 for ejecting the pyrophoric fluid, the relative positions of the axes 123 and 115 and the respective orientations of the nozzles 118 and 124 causing the pyrophoric fluid 1 to mix with the oxidizing fluid 2 in an area offset downstream relative to the device, in which area the pyrophoric fluid 1 ignites spontaneously in contact with the oxidizing fluid 2.

In the upstream direction the pipe 122 has on the axis 123 an opening 125 into the reservoir 121. In the immediate vicinity of this opening 125 it has a valve 126 which is identical to the valve 29 described above, for example; the valve 126 is closed in the direction from the nozzle 124 to the opening 125 and is adapted to open to enable the pyrophoric fluid 1 to flow in a direction from the opening 125 to the nozzle 124 via the conduit 122 when the pressure of the pyrophoric fluid 1 in the reservoir 121 exceeds a predetermined threshold, which is advantageously the same as the predetermined threshold at which the valve 29 opens, although this is not essential.

To delimit the reservoir 122 with its surface 107 the plate 101 has fastened and sealed to it a tubular sealed longitudinal skirt 127 concentric with the axis 8 and projecting in the upstream direction relative to the surfaces 107 and 104.

In the direction away from the axis 8 the skirt 127 is delimited by an outside peripheral surface 128 which is a cylinder of revolution about the axis 8 with a diameter substantially equal to that of the inside peripheral surface 17 of the tubular body 6 with which the surface 128 is in contact and on which it can slide longitudinally, in particular when the subassembly 3 is mounted on the subassembly 4.

In the direction towards the axis 8 the skirt 127 is delimited by an inside peripheral surface 129 which is also a cylinder of revolution about the axis 8 with a diameter substantially equal to that of the surface 107.

In the downstream direction the surface 128 has an annular step (no reference number) concentric with the axis 8 to bear in the downstream direction on the surface 104 and continuing, with a smaller diameter equal to that of the inside peripheral surface 105 in the plate 101, to the inside of the groove 106 where it joins onto the inside peripheral surface 129 at a plane annular edge 130 of the skirt 127 which is concentric with the axis 8, to which it is perpendicular and which faces downstream.

Facing the inside peripheral surface 129 of the skirt 127 the groove 106 has an annular recess 131 concentric with the axis 8, facing away from the latter and enclosing an annular seal 132 providing a seal between the skirt 127 and the plate 101, both of which are sealed.

In the longitudinal direction, the skirt 127 projects relative to the surface 104 of the plate 101 by a distance approximately equal to the longitudinal distance between the surface 15 and the surface 18 of the tubular body 6, being slightly less than this dimension. At this point it has fastened to it a flat annular end rim 133 concentric with the axis 8 and projecting towards the latter relative to the inside peripheral surface 129.

To be more precise, the rim 133 is delimited by surfaces of revolution about the axis 8, a plane transverse annular surface 134 facing upstream and therefore facing the surface 18 of the tubular body 6 with which it defines, given the aforementioned dimensions, an intermediate volume 135 communicating with the exterior of the device through the vent passage 19, a plane annular surface 136 perpendicular to the axis 8 but facing downstream, and an edge surface 137 which is a cylinder of revolution about the axis 8, faces towards the latter and has a diameter greater than that of the inside peripheral surface 22 of the flange 26 of the tubular body 6, although less than the respective diameters of the surfaces 129 and 128 onto which this surface 137 joins, in the direction away from the axis 8, respectively through the surfaces 136 and 134.

The edge surface 137 of the rim 133 provides a longitudinal passage for the piston rod 48 of the piston 7 when the latter moves from its upstream limit position, as shown, to its downstream limit position.

The reservoir 121, delimited in the downstream direction by the surface 107 of the plate 101 and in the direction away from the axis 8 by the surface 129 of the skirt 127, is delimited in the upstream direction by a surface 138 of the piston 49, which surface 138 forms a disk perpendicular to the axis 8, centered on the latter and facing downstream.

The surface 138, inside the skirt 127, is joined in the direction away from the axis 8 onto an outside peripheral surface 139 of the piston 49 which is a cylinder of revolution about the axis 8, faces away from the latter and has a diameter substantially equal to that of the surface 129 with which it is in contact in order to guide their relative longitudinal sliding motion.

An annular groove 140 concentric with the axis 8 in the surface 139 accommodates an annular seal 141 concentric with the axis 8 in sliding contact with the surface 129 to provide a seal between the latter and the piston 49, the surface 129 providing a cylinder whose end wall is formed by the surface 107 of the plate 101.

In the upstream direction the surface 139 of the piston 49 joins onto a plane annular surface 142 concentric with the axis 8 to which it is perpendicular. This surface 142, facing upstream, of the piston 49 bears on the surface 136 of the rim 133 of the skirt 127 in an upstream limit position of the piston 49 representing a maximal volume of the reservoir 121 by maximal longitudinal separation of the surface 138 of the piston 49 from the surface 107 of the plate 101 and against the surface 44 of the piston rod 48 of the piston 7, both in this upstream limit position which represents the upstream limit position of the piston 7 by virtue of the choice of appropriate longitudinal dimensions, and in any longitudinal position of the piston 7 from this upstream limit position to its downstream limit position, corresponding to a downstream limit position of the piston 49; in this downstream limit position the surface 138 of the latter adjoins the surface 107 of the plate 101, the reservoir 121 and the reservoir 21 then simultaneously having their minimal, advantageously zero volume. To this end, with reference to the respective upstream limit positions of the pistons 49 and 50, the longitudinal distance between the surface 138 of the piston 49 and the surface 107 of the plate 101 is identical to the longitudinal distance between the surface 39 of the piston 7 and the surface 25 of the flange 26 of the tubular body 6, and this continues to be so regardless of the respective positions of the piston 7 and the piston 49 inside the tubular body 6 and inside the skirt 127.

Under such conditions, the forced expulsion of the pyrophoric fluid 1 from the reservoir 121 and its ejection through the nozzle 124 accompanies forced expulsion of the oxidizing fluid 2 and its ejection through the nozzle 118. The ratio between the surface area of the surface 138 of the piston 49 and that of the surface 39 of the piston 7, chosen accordingly, determines at all times the relative proportion of the respective ejection rates of the pyrophoric fluid 1 and the oxidizing fluid 2 through the associated nozzles 124, 118, i.e. the proportions in which the two fluids mix, which are therefore constant and accurately defined regardless of the longitudinal position of the pistons 7 and 49 relative to the tubular body 6 and the skirt 127, respectively, i.e. regardless of the degree of mixing of the reservoirs 21 and 121, which constitutes a decisive advantage as compared with the device described in the aforementioned Canadian patent application.

The flowrate and pressure conditions under which mixing occurs and the area in which mixing occurs, relative to the device, can naturally be controlled by appropriate design of the nozzles 118 and 124 and the valves 29 and 126, as will be readily apparent to the person skilled in the art.

As shown, the piston rod 48 of the piston 7 preferably not only pushes the piston 49 in the direction 9 as it moves in this direction inside the tubular body 6, but also maintains the transverse orientation of the piston 49 relative to the axis 8.

To this end, in the direction towards the axis 8 the surface 142 is joined at a circle whose diameter is substantially equal to the diameter of the inside peripheral surface 45 of the piston rod 48 to a rod 143 projecting longitudinally upstream from the surface 142, to be more precise an outside peripheral surface 144 of the rod 143 which is a cylinder of revolution about the axis 8 and faces away from the latter; the surface 144 of the rod 143 has a diameter substantially equal to that of the inside peripheral surface 45 of the piston rod 48, whose cavity 47 the rod 143 therefore enters longitudinally, with the facility for relative longitudinal sliding on fitting the subassembly 3 to the subassembly 2, which is effected by longitudinal translation movement of the subassembly 3 formed by the plate 101, the skirt 127 and the piston 49, at this time fixed in its upstream limit position, relative to the subassembly 4 formed by the tubular body 6 and the piston 7 in its upstream limit position.

In the upstream direction the surface 144 is joined by a frustoconical facet 145 concentric with the axis 8 and converging in the upstream direction to a plane transverse surface 146 perpendicular to the axis 8 and concentric therewith; the surface 146, facing upstream, is at a longitudinal distance from the surface 142 slightly less than that between the surfaces 44 and 46 of the piston rod 48, to allow the aforementioned bearing of the surface 142 of the piston 49 on the surface 44 of the piston rod 48, in the upstream direction.

The person skilled in the art will readily understand that the embodiment of the invention just described is merely one non-limiting example, which can be varied in numerous ways, in particular with regard to the relative location of the two piston and cylinder combinations respectively constituted by the surface 27 and the piston 7 and by the surface 9 and the piston 49 and which, rather than being longitudinally aligned, could be mutually interleaved or transversely juxtaposed, for example; displacement of one of the pistons by the displacement of the other piston will nevertheless be retained to constitute a particularly simple and efficient way of achieving perfect synchronization between the respective displacements of the pistons, i.e. between the ejections of the respective associated fluids.

The person skilled in the art will also readily understand that the pyrophoric fluid 1 and the oxidizing fluid 2 could be contained in the respective reservoirs 21 and 121 and that the fluids ejected simultaneously could be other than a pyrophoric fluid and an oxidizing fluid, and could be of a non-pyrotechnic kind where it would be necessary to guard against any premature mixing and to cause such mixing to occur only at some distance from the device.

Also, dependent on the application of the device, the number of pistons operating simultaneously could be greater than two.

There is claimed:

1. Device for simultaneously ejecting two fluids, in particular pyrotechnic fluids, intended to react upon contact after ejection, said device comprising:

first and second sealed reservoirs for the first and second of said fluids, respectively, said first and second reservoirs being mutually isolated to prevent contact between said first and second fluids, first and second ejector nozzles for said first and second fluids, respectively, first and second sealed conduits respectively connecting said first nozzle to said first reservoir and said second nozzle to said second reservoir and mutually isolated to prevent contact between said two fluids, means operable to expel said first and second fluids simultaneously from said first and second reservoirs to said first and second nozzles via said first and second conduits, in which device said first and second reservoirs comprise first and second coaxial cylinders closed at the end which is the downstream end with reference to a common axial direction by a respective end wall into which said first conduit or said second conduit respectively opens, and said means for simultaneously expelling said first and second fluids include first and second pistons adapted to slide axially in at least said direction inside said first and second cylinders, respectively, and closing said first and second cylinders, respectively, at the upstream end with reference to said direction, said second piston being mechanically coupled to said first piston so that sliding of said first piston in said direction inside said first cylinder causes sliding of said second piston in said direction inside said second cylinder, and means for causing sliding of said first piston in said direction inside said first cylinder.

2. Device according to claim 1 comprising at least two sealed subassemblies stored separately and adapted to be assembled together for use, namely a first subassembly comprising said first cylinder containing said first fluid, the respective end wall and said first piston, and a second subassembly comprising said second cylinder containing said second fluid, the respective end wall and said second piston.

3. Device according to claim 2 further comprising a third subassembly separate from said first and second subassemblies in storage and assembled to said first and second subassemblies for use, said third subassembly including said means for causing sliding of said first piston.

4. Device according to claim 1 wherein said means for causing sliding of said first piston include a pyrotechnic generator producing pressurized gas acting on said first piston in said first cylinder in opposition to said first fluid.

5. Device according to claim 1 wherein said means for causing sliding of said first piston, said first cylinder and said second cylinder are axially aligned in said direction.

6. Device according to claim 5 wherein said first piston includes an axial piston rod adapted to push said second piston in said direction, said piston rod projecting axially in said direction relative to said first piston through said first cylinder and the respective end wall in order to engage with said second piston.

7. Device according to claim 1 further comprising, at the opening of each of said first conduit and said second conduit onto the respective end wall, a normally closed valve opening towards said first conduit or said second conduit, respectively, when the pressure in said first or said second cylinder, respectively, exceeds a predetermined threshold.

8. Device according to claim 1 for use as an infra-red flare wherein said first and second fluids comprise an oxidizing fluid and a pyrophoric fluid.

* * * * *